US011780246B2

(12) United States Patent
Hara et al.

(10) Patent No.: US 11,780,246 B2
(45) Date of Patent: Oct. 10, 2023

(54) POST-PROCESSING DEVICE AND RECORDING SYSTEM

(71) Applicant: Seiko Epson Corporation, Tokyo (JP)

(72) Inventors: Shun Hara, Matsumoto (JP); Kazuhisa Kawakami, Matsumoto (JP); Yu Tsumuraya, Ota-ku (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/555,638

(22) Filed: Dec. 20, 2021

(65) Prior Publication Data

US 2022/0194101 A1 Jun. 23, 2022

(30) Foreign Application Priority Data

Dec. 21, 2020 (JP) ..... 2020-211189

(51) Int. Cl.
*B41J 11/00* (2006.01)

(52) U.S. Cl.
CPC ..... *B41J 11/0055* (2013.01); *B41J 11/0015* (2013.01); *B41J 11/0085* (2013.01)

(58) Field of Classification Search
None
See application file for complete search history.

(56) References Cited

U.S. PATENT DOCUMENTS

| | | | | |
|---|---|---|---|---|
| 11,413,886 | B2 | 8/2022 | Kondo | |
| 2010/0072693 | A1* | 3/2010 | Ishikawa | B65H 35/04 271/232 |
| 2018/0312363 | A1* | 11/2018 | Noso | B65H 37/04 |
| 2020/0101768 | A1 | 4/2020 | Kondo | |

FOREIGN PATENT DOCUMENTS

| | | | |
|---|---|---|---|
| CN | 110963349 | | 4/2020 |
| JP | 2014189384 | A * | 10/2014 |
| JP | 2018-188237 | | 11/2018 |

OTHER PUBLICATIONS

Yanami, Tetsushi, Feeding Device and Recording Device, Oct. 6, 2014, Japan, All (Year: 2014).*
Maemura Akihito, Separate Type Sheet Storing Device, Dec. 16, 2004, Japan, All Pages (Year: 2004).*

* cited by examiner

*Primary Examiner* — Justin Seo
*Assistant Examiner* — Tracey M McMillion
(74) *Attorney, Agent, or Firm* — WORKMAN NYDEGGER

(57) ABSTRACT

An end unit includes: a processing tray including an upper surface on which a medium subjected to recording by a recording unit is mounted; a first paddle and a second paddle that transport, in direction +A, the medium mounted on the upper surface; an alignment section that aligns an edge portion of the medium, which was transported in direction +A by the first paddle and the second paddle, in direction +A; a post-processing section that performs post-processing for the medium aligned by the alignment section; and a load member that applies a load when the medium on the processing tray moves in direction −A opposite to direction +A.

10 Claims, 11 Drawing Sheets

POST-PROCESSING DEVICE AND RECORDING SYSTEM

The present application is based on, and claims priority from JP Application Serial Number 2020-211189, filed Dec. 21, 2020, the disclosure of which is hereby incorporated by reference herein in its entirety.

BACKGROUND

1. Technical Field

The present disclosure relates to a post-processing device and a recording system.

2. Related Art

A post-processing device in which, as described in JP-A-2018-188237, a reinforcing sheet is provided on an elastic sheet that draws a sheet to a predetermined position in a processing tray has been known.

In JP-A-2018-188237, the configuration is such that the elastic sheet is reinforced by the reinforcing sheet to thereby improve sheet-transporting performance of the elastic sheet and enable the elastic sheet to draw even a sheet on which a frictional force on the sheet surface has increased due to an image being formed by using an ink jet system.

However, the configuration in which the transporting performance is improved as described in JP-A-2018-188237 has a problem that a drawn sheet rebounds at a position of a receiving plate provided in the processing tray, thereby causing misalignment.

SUMMARY

A post-processing device includes: a processing tray including a mounting surface on which a medium subjected to recording by a liquid ejecting apparatus is mounted; a transporting member that transports, in a first direction, the medium mounted on the mounting surface; an edge alignment section that aligns an edge portion of the medium, which was transported in the first direction by the transporting member, in the first direction; a post-processing section that performs post-processing for the medium aligned by the edge alignment section; and a load applying section that applies a load when the medium on the processing tray moves in a second direction opposite to the first direction.

BRIEF DESCRIPTION OF THE TRANSPORTINGS

DESCRIPTION OF EXEMPLARY EMBODIMENTS

First Embodiment

A first embodiment of a recording apparatus, a medium-mounting device, and a post-processing device according to the disclosure will be hereinafter described with reference to the accompanying transportings.

Figure 1:
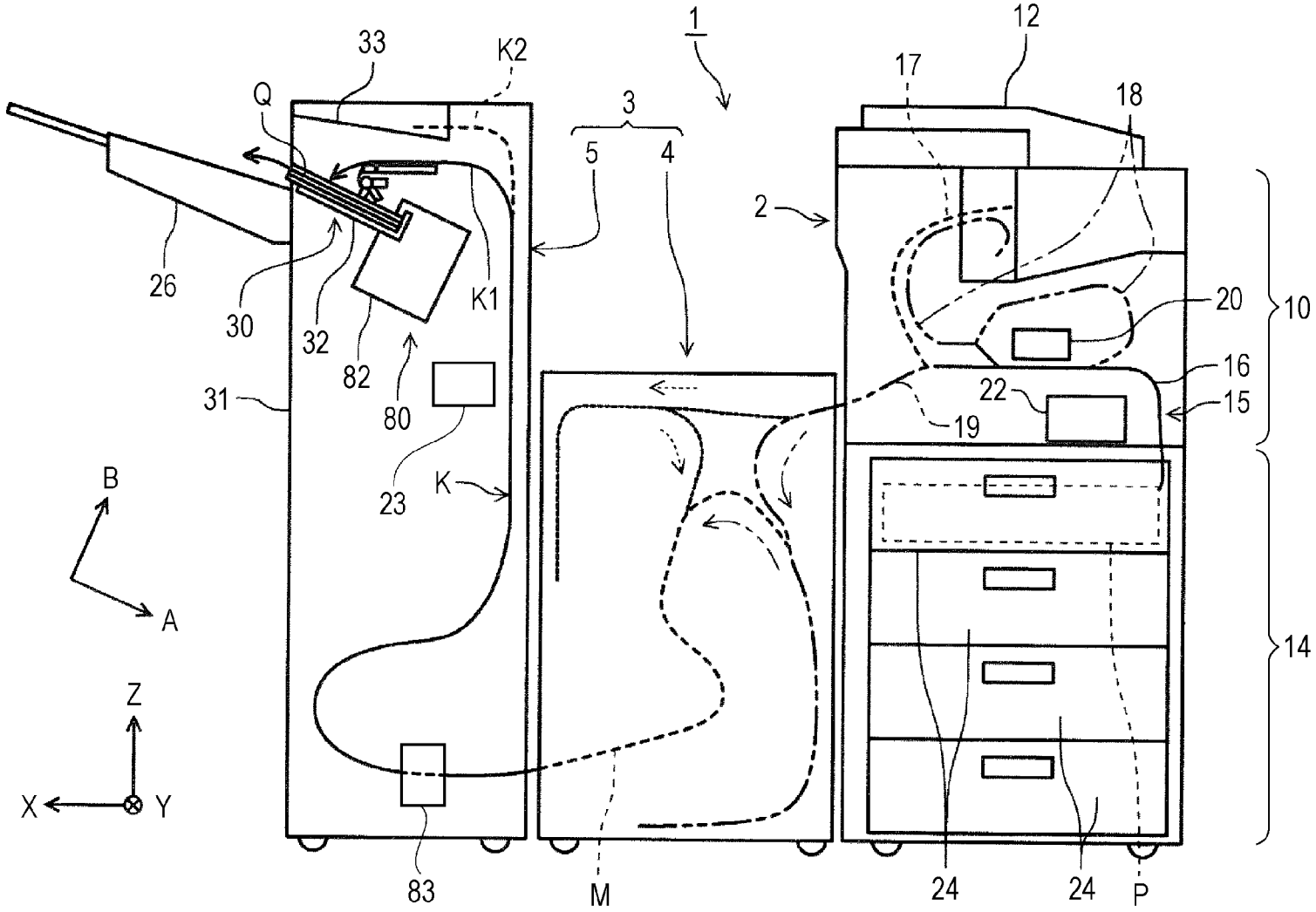
FIG. 1 is a schematic view illustrating an entire configuration of a recording system according to a first embodiment.

FIG. 1 illustrates a recording system 1, which is an example of a recording apparatus. The recording system 1 is constituted as an ink jet apparatus that ejects ink, which is an example of a liquid, onto a medium P, such as a recording sheet, to perform recording.

In the X-Y-Z coordinate system illustrated in each of the transportings, the X direction is an apparatus width direction, the Y direction is an apparatus depth direction, and the Z direction is an apparatus height direction. The X direction, the Y direction, and the Z direction are orthogonal to each other.

When the right and the left are distinguished in the apparatus width direction, the left is referred to as the +X direction, and the right is referred to as the −X direction. When the front and the rear are distinguished in the apparatus depth direction, the front is referred to as the −Y direction, and the rear is referred to as the +Y direction. When the upper side and the lower side are distinguished in the apparatus height direction, the upper side is referred to as the +Z direction, and the lower side is referred to as the −Z direction.

The recording system 1 includes a recording unit 2 and a post-processing unit 3 in this order toward the +X-direction side. Note that the recording system 1 is configured such that the recording unit 2 and the post-processing unit 3 are mechanically and electrically coupled to each other and such that the medium P is able to be transported from the recording unit 2 to the post-processing unit 3.

The recording system 1 is provided with an operation panel (not illustrated) which is operated by an operator. The operation panel enables various settings of the recording unit 2 and the post-processing unit 3 to be input. Note that the recording system 1 is configured such that the medium P on which information has been recorded by a printer section 10 described later is subjected to post-processing described later. An operational effect similar to that of the post-processing unit 3 described later is able to be obtained by the recording system 1.

The recording unit 2 is an example of a liquid ejecting apparatus and records various types of information on the transported medium P. A sheet is used for the medium P, for example. The recording unit 2 includes the printer section 10, a scanner section 12, and a cassette accommodating section 14.

The printer section 10 includes a line head 20 and a first control section 22. The printer section 10 performs recording on the medium P.

The line head 20 is configured to be a recording head that ejects ink onto the medium P to thereby record various types of information on the medium P.

The first control section 22 includes a CPU (central processing unit), memory, and the like, which are not illustrated, and controls operation of transporting the medium P and recording various types of information on the medium P in the recording unit 2.

The scanner unit 12 reads information of a document (not illustrated). The information of the document which has been read by the scanner section 12 is stored in the memory of the first control section 22.

The cassette accommodating section 14 includes a plurality of accommodating cassettes 24 that accommodate a plurality of media P. A transport path 15 on which the medium P is transported is formed in the printer section 10 and the cassette accommodating section 14.

The transport path 15 includes, for example, a paper feed path 16, a discharge path 17, an inversion path 18, and a transfer path 19. Roller pairs (not illustrated) are provided on each path of the transport path 15. On the transport path 15, the medium P is transported from an accommodating cassette 24 to a recording region of the line head 20 and, furthermore, transported from the recording region to the post-processing unit 3.

The post-processing unit 3 includes an intermediate unit 4 that transports the medium P received from the recording unit 2 and includes an end unit 5 that performs post-processing collectively for the necessary number of media P received from the intermediate unit 4. The end unit 5 is an example of the post-processing device. The post-processing unit 3 is able to obtain an operational effect similar to that of the end unit 5.

The intermediate unit 4 transports the medium P received from the recording unit 2 and transfers the medium P to the end unit 5. A transport path M on which the medium P received from the recording unit 2 is transported is formed in the intermediate unit 4.

A transport path K on which the medium P from the intermediate unit 4 is transported is formed in the end unit 5. The transport path K includes, for example, a main transport path K1 extending toward a post-processing section 80 described below and includes a sub-transport path K2 extending toward an upper tray 33.

The end unit 5 includes a stacking unit 30, which is an example of a medium-stacking device, the post-processing section 80 that performs post-processing for a plurality of media P, and a second control section 23. Moreover, the end unit 5 includes a housing 31 corresponding to a device main body. The housing 31 includes the upper tray 33 and a discharge tray 26. A medium P which is not to be subjected to post-processing by the post-processing section 80 is discharged to the upper tray 33. A medium P which has been subjected to post-processing by the post-processing section 80 is discharged to the discharge tray 26.

The second control section 23 includes a CPU, memory, and the like, which are not illustrated, and is able to control various types of operation in the post-processing unit 3.

In the end unit 5, the Y direction is an example of a width direction intersecting a direction in which the medium P is introduced to the stacking unit 30. Moreover, in the present example, a direction in which the medium P is introduced to or discharged from the stacking unit 30 is referred to as direction A. Direction A is, for example, a direction orthogonal to the Y direction when viewed in the Z direction and intersecting the X direction when viewed in the Y direction. Further, direction A is inclined such that the −X-direction side is lower than the +X-direction side when viewed in the Y direction. A direction orthogonal to direction A when viewed in the Y direction is referred to as direction B.

In the description below, in direction A, a direction in which the medium P is transported toward the post-processing section 80 is referred to as direction +A, and a direction in which the medium P separates from the post-processing section 80 is referred to as direction −A. Direction +A is an example of a first direction, and direction −A is an example of a second direction. Moreover, in direction B, a direction in which the media P are stacked is referred to as direction +B, and a direction opposite to direction +B is referred to as direction −B. Direction +B is an example of a stacking direction.

Figure 2:
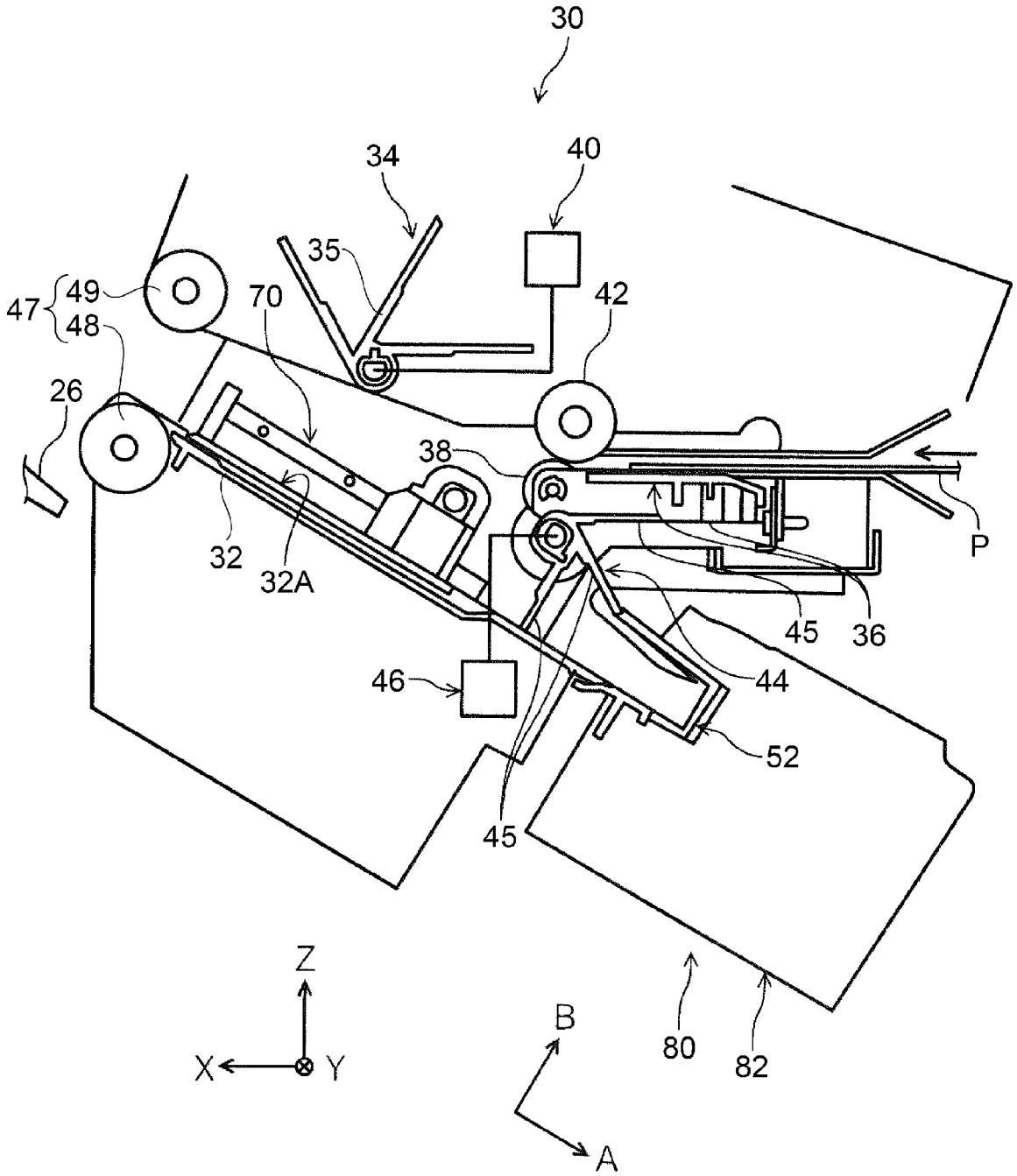
FIG. 2 is a schematic view illustrating a processing tray and a periphery thereof according to the first embodiment.

As illustrated in FIG. 2, the stacking unit 30 includes a processing tray 32, an alignment section 52, which corresponds to an edge alignment section, and a first paddle 34 and a second paddle 44, each of which corresponds to a transporting member. Moreover, a lower guide member 36, a transporting roller 38, a first drive section 40, an auxiliary roller 42, a side cursor 70, a second drive section 46, and a roller pair 47, which corresponds to a discharging section, are provided in the stacking unit 30. The roller pair 47 includes a first discharging roller 48, which corresponds to a first roller, and a second discharging roller 49, which is provided so as to face the first discharging roller 48 and corresponds to a second roller.

The lower guide member 36 constitutes a portion of the main transport path K1 (refer to FIG. 1).

The transporting roller 38 and the auxiliary roller 42 hold the medium P, which is on the lower guide member 36, therebetween and transport the medium P in the +X direction.

The processing tray 32 is an example of a mounting section and is configured such that media P on which recording has been performed by the printer section 10 (refer to FIG. 1) of the recording unit 2 are mounted and stacked on the processing tray 32. Specifically, the processing tray 32 has a planar plate-like shape which expands in direction A and the Y direction. Moreover, the processing tray 32 extends in direction A such that the edge portion on the direction −A side is positioned in the +Z direction with respect to the edge portion on the direction +A side. A width of the processing tray 32 in the Y direction is wider than a width of the medium P in the Y direction.

When a plurality of media P are sequentially mounted on an upper surface 32A, which is the surface of the processing tray 32 on the direction +B side, the plurality of media P are stacked on the processing tray 32, and a medium bundle Q (FIG. 1) is formed after post-processing. The upper surface 32A is an example of a mounting surface.

The first paddle 34 is provided in the +Z direction with respect to the processing tray 32 so as to be rotatable with the Y direction as the axial direction. Specifically, the rotation center of the first paddle 34 is positioned above the processing tray 32 so as to be on the direction −A side with respect to the rotation center of the second paddle 44 when viewed in the Y direction. The first paddle 34 includes, for example, three first blade sections 35.

Two sets of three first blade sections 35 are provided with a gap therebetween in the Y direction. The three first blade sections 35 are made of, for example, rubber and each have a rectangular plate-like shape having a predetermined thickness in the rotational direction.

The first paddle 34 is rotated or stopped by the first drive section 40 that includes a motor and a gear, which are not illustrated. Drive of the motor is controlled by the second control section 23. Here, when the second control section 23 controls the first drive section 40 to rotate the first paddle 34, the three first blade sections 35 come into contact with the medium P and apply a transporting force. The medium P on the processing tray 32 is thereby introduced toward the alignment section 52. In other words, the first paddle 34 rotates to thereby transport the medium P on the processing tray 32 in direction +A.

The second paddle 44 moves the medium P introduced to the processing tray 32 toward the alignment section 52.

Specifically, the second paddle 44 is rotatably provided with the Y direction as the axial direction such that the rotation center is positioned between the processing tray 32 and the lower guide member 36 when viewed in the Y direction. Moreover, the second paddle 44 includes, for example, three second blade sections 45.

Two sets of three second blade sections 45 are provided with a gap therebetween in the Y direction. The three second blade sections 45 are made of, for example, rubber and each have a rectangular plate-like shape having a predetermined thickness in the rotational direction.

The second drive section 46 includes a motor and a gear, which are not illustrated. Drive of the motor is controlled by the second control section 23. Here, when the second control section 23 controls the second drive section 46 to rotate the second paddle 44, the three second blade sections 45 come into contact with the medium P. The medium P on the processing tray 32 is thereby introduced toward the alignment section 52.

The alignment section 52 is provided in the edge portion of the processing tray 32 on the direction +A side. The alignment section 52 aligns the edge portion of the medium P, introduced to the processing tray 32, on the direction +A side. Three alignment sections 52 are provided so as to be arrayed in the Y direction. In the present embodiment, "align" means aligning the edge of the medium P on the direction +A side.

Figure 3:
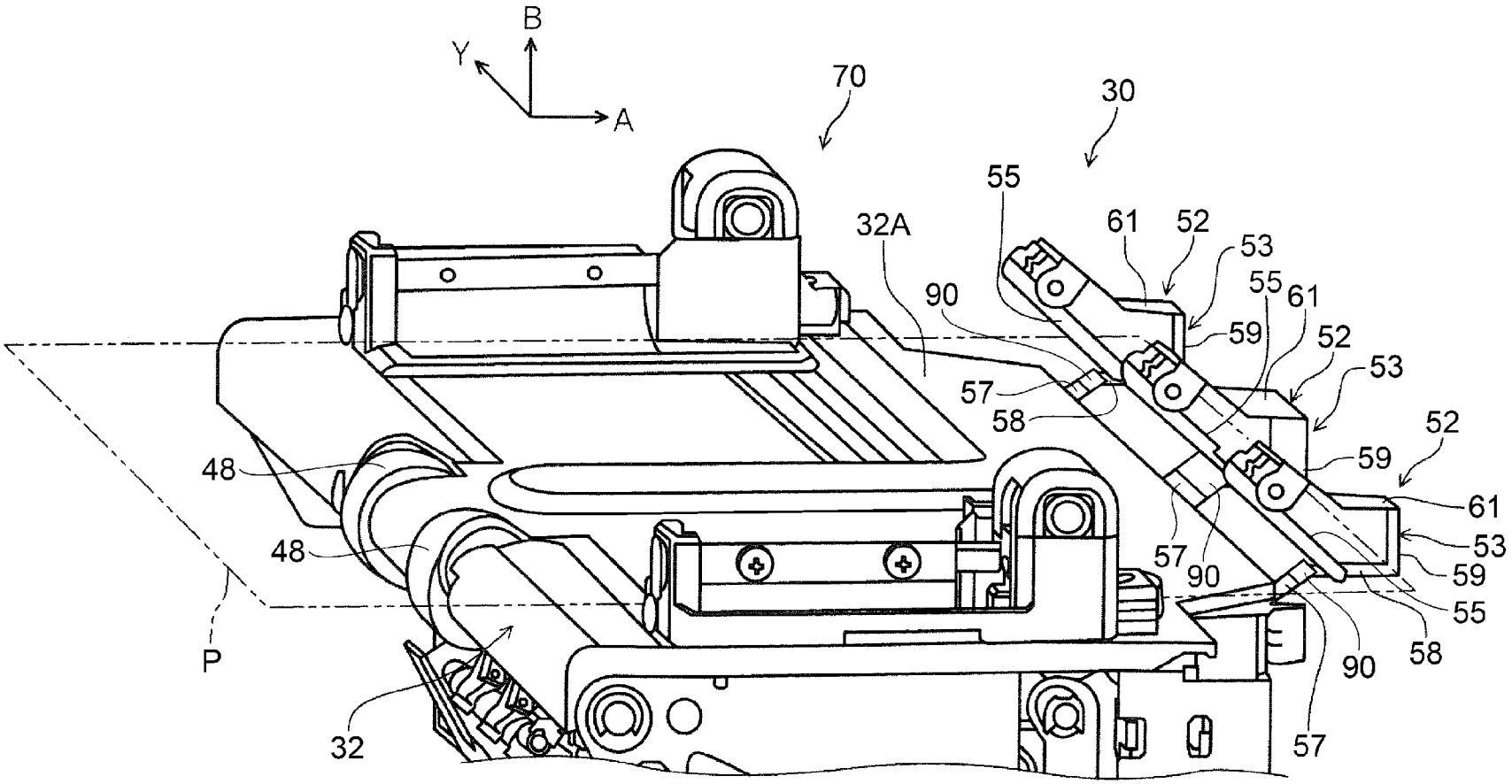
FIG. 3 is a perspective view illustrating the processing tray and a periphery thereof according to the first embodiment.
Figure 4:
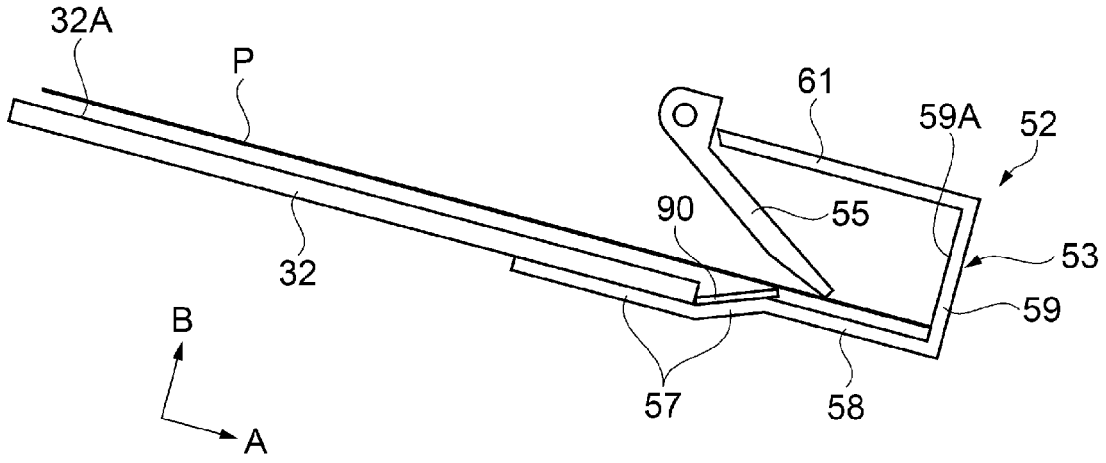
FIG. 4 is a sectional view of the processing tray according to the first embodiment.

As illustrated in FIGS. 3 and 4, the alignment section 52 includes, for example, a main body member 53 and a pressing member 55.

The main body member 53 is made of, for example, a metal sheet bent at plural places and is open in direction −A. Specifically, the main body member 53 includes a fixation section 57, a lower plate section 58, a longitudinal plate section 59, and an upper plate section 61.

The fixation section 57 is fixed to the processing tray 32. The lower plate section 58 extends from the fixation section 57 in direction +A.

The longitudinal plate section 59 stands upright in direction +B from the edge portion of the lower plate section 58 on the direction +A side. A height of the longitudinal plate section 59 in direction +B is set in accordance with a maximum thickness of the medium bundle Q. When coming into contact with the edge portion of the medium P or the medium bundle Q on the direction +A side, the longitudinal plate section 59 aligns the edge portion. A front surface 59A of the longitudinal plate section 59 on the direction −A side is a planar surface expanding in the Y-B plane. When coming into contact with the end surfaces of a plurality of media P on the direction +A side, the front surface 59A aligns the plurality of end surfaces.

The upper plate section 61 extends in the direction −A from the edge portion of the longitudinal plate section 59 on the direction +B side. The edge portion of the upper plate section 61 on the direction −A side is arrayed, in direction B, with the edge portion of the processing tray 32 on the direction +A side.

The pressing member 55 has a plate-like shape when viewed in the Y direction. The edge portion of the pressing member 55 on the direction −A side is coupled to the edge portion of the upper plate section 61 on the direction −A side such that the pressing ember 55 is pivotable with the Y direction as the axial direction. The edge portion of the pressing member 55 on the direction +A side extends obliquely toward the longitudinal plate section 59. In other words, the edge portion of the pressing member 55 on the direction +A side is lowered due to the weight of the pressing member 55. Accordingly, the pressing member 55 presses the medium P in direction −B to thereby suppress the medium P from rising.

Figure 6:
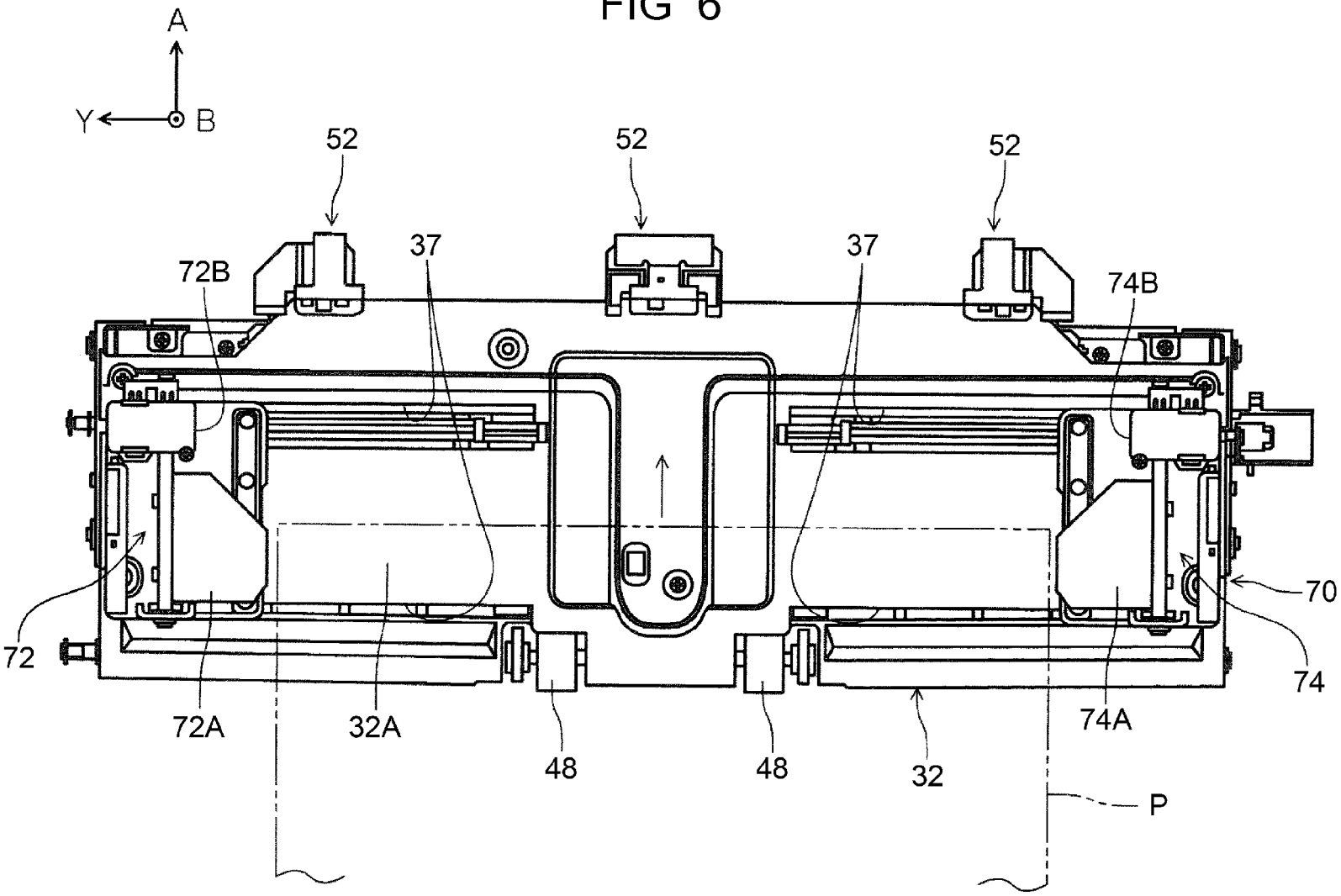
FIG. 6 is a plan view of the processing tray according to the first embodiment.

As illustrated in FIG. 6, the side cursor 70 is an example of a moving member and is provided in the processing tray 32. The side cursor 70 moves the medium P on the processing tray 32 in the Y direction. Specifically, the side cursor 70 is constituted by a first cursor 72 and a second cursor 74 that are positioned on respective sides of the medium P in the Y direction.

The first cursor 72 includes a bottom plate section 72A that supports the +Y-direction side portion of the medium P and a side plate section 72B that holds the side portion from the side.

The second cursor 74 includes a bottom plate section 74A that supports the −Y-direction side portion of the medium P and a side plate section 74B that holds the side portion from the side.

A portion of the first cursor 72 and a portion of the second cursor 74 are each inserted into a guide slit 37 and are each able to move along the guide slit 37 in the Y direction. Moreover, the first cursor 72 and the second cursor 74 are able to move automatically in the Y direction when, for example, driven by a drive section (not illustrated).

The first cursor 72 and the second cursor 74 align both of the Y-direction edge portions of the media P stacked on the processing tray 32. Further, when the first cursor 72 and the second cursor 74 move in the +Y direction or the −Y direction in a state of holding the media P or the medium bundle Q therebetween in the Y direction, the first cursor 72 and the second cursor 74 move the media P or the medium bundle Q in the Y direction.

As illustrated in FIG. 1, the post-processing section 80 performs post-processing for a plurality of media P mounted on the mounting unit 30. Note that, in the present embodiment, "post-processing" means processing performed for a medium P on which information has been recorded by the recording unit 2. Specifically, the post-processing section 80 includes a stapler 82.

The stapler 82 is arranged in direction +A with respect to the processing tray 32. When driven by a motor (not illustrated), the stapler 82 is able to move in the Y direction. Furthermore, the stapler 82 is configured to perform edge binding processing for the aligned edge portion of the medium bundle Q on the direction +A side when the operation of the stapler 82 is controlled by the second control section 23. The edge binding processing is an example of post-processing.

As illustrated in FIG. 2, the roller pair 47 rotates to transfer the medium bundle Q on the processing tray 32 toward the discharge tray 26. The medium bundle Q is obtained when a bundle of a plurality of media P is subjected to post-processing by the post-processing section 80.

Next, post-processing operation will be described.

As illustrated in FIGS. 1 and 2, in the end unit 5, the medium P transferred from the intermediate unit 4 passes through the main transport path K1 and is discharged onto the processing tray 32 by the transporting roller 38 and the auxiliary roller 42. At this time, a medium-detecting sensor (not illustrated) provided on the main transport path K1 detects passage of the medium P.

When a predetermined time has elapsed after the medium P is detected by the medium-detecting sensor (not illustrated), the medium P discharged onto the processing tray 32 is transported to the alignment section 52 by the first paddle 34 and the second paddle 44 and aligned.

Specifically, first, the first paddle 34 rotates in a counter-clockwise direction in FIG. 2 while in contact with the medium P mounted on the processing tray 32. The medium P is thereby transported in direction +A.

When the medium P is transported to a predetermined position by the first paddle 34, the second paddle 44 starts rotating. The second paddle 44 rotates in the same direction as the first paddle 34 and, when rotating, comes into contact with the medium P to apply a transporting force. The medium P is thus transported to the alignment section 52 also by the second paddle 44, and the edge portion on the direction +A side is aligned by the alignment section 52.

At this time, a timing at which the second paddle 44 starts rotating may be a timing at which the first paddle 34 starts rotating or a timing after the medium P reaches the alignment section 52.

Rotation of the first paddle 34 and rotation of the second paddle 44 are stopped when a predetermined time has elapsed after each of the paddles starts rotating. A timing at which the first paddle 34 and the second paddle 44 are stopped is a timing at which the medium P reaches the alignment section 52.

At this time, the predetermined time may be the same or different between the first paddle 34 and the second paddle 44.

After the first paddle 34 and the second paddle 44 stop rotating, the first cursor 72 and the second cursor 74 align both of the Y-direction edge portions of media P stacked on the processing tray 32.

When the succeeding medium P is transported after both of the edge portions of the media P are aligned, the first cursor 72 and the second cursor 74 are moved to retreat positions, and the succeeding sheet is received. At this time, the retreat positions are located outside the width of the media P in the Y direction.

The succeeding medium P is transported in direction +A by the first paddle 34 and the second paddle 44 and then subjected to an aligning operation by the first cursor 72 and the second cursor 74.

The aligned medium bundle Q is obtained when rotation of the first paddle 34 and the second paddle 44 and the aligning operation performed by the first cursor 72 and the second cursor 74 are alternately performed in the above-described manner.

The aligned medium bundle Q is subjected to post-processing by the post-processing section 80. Examples of post-processing include binding processing in which the edge portion of the medium bundle Q is bound by the stapler and shift processing in which the medium bundle Q is shifted and discharged. The medium bundle Q subjected to post-processing is transported in direction −A by the roller pair 47 and discharged to the discharge tray 26.

In the process in which the medium bundle Q is obtained, misalignment of the edge portion of the medium bundle Q on the direction +A side may be caused. The misalignment will be described below.

First, misalignment of a first medium P mounted on the processing tray 32 will be described. Hereinafter, the first medium P mounted on the processing tray 32 is referred to as a medium P1.

The first paddle 34 and the second paddle 44 rotate with respect to the medium P1 discharged onto the processing tray 32 and transport the medium P1 in direction +A. The first paddle 34 and the second paddle 44 transport the medium P1 until the medium P1 reaches the alignment section 52.

At this time, when a transporting force of the first paddle 34 and the second paddle 44 is large, the medium P1 is pressed against the alignment section 52 and bent.

Bending of the medium P1 is eliminated when the first blade section 35 of the first paddle 34 and the second blade section 45 of the second paddle 44 separate from the medium P1. Elimination of the bending results in a force for moving in direction −A being applied to the medium P1, and, upon receiving the force, the medium P1 moves in direction −A.

This is misalignment caused in the first medium P1 mounted on the processing tray 32.

To reduce the aforementioned misalignment, the fixation section 57 of each of the alignment sections 52 of the present embodiment is provided with a load member 90, which corresponds to a load applying section, as illustrated in FIGS. 3 and 4.

In the present embodiment, a thin plate formed of a PET resin is used as the load member 90. However, the material of the load member 90 is not limited thereto, and a load member 90 formed of another material may be used. Moreover, the load member 90 may be formed by bending the metal sheet of the fixation section 57 upright.

As illustrated in FIG. 4, the load member 90 protrudes in direction +B with respect to the upper surface 32A of the processing tray 32 and is inclined such that the tip end thereof faces direction +A. In other words, the load member 90 is provided so as to protrude upward from the upper surface 32A of the processing tray 32 and protrude toward the alignment section 52.

Due to the presence of the aforementioned configuration, the load member 90 hinders potential movement of the medium P1 on the processing tray 32 in direction −A by coming into contact with the medium P1 and applying a load.

Accordingly, possible movement of the medium P1 in direction −A is reduced, and misalignment of the first medium P1 mounted on the processing tray 32 is able to be reduced.

Next, misalignment caused when the medium bundle Q is being formed will be described.

Hereinafter, the first medium P mounted on the processing tray 32 is referred to as the medium P1, and a medium P which is mounted on or above the medium P1 and which is being transported by the first paddle 34 and the second paddle 44 in direction +A is referred to as a medium P2. Note that the medium P2 is not limited to a second medium P and may be a third medium P or a medium P after the third medium P.

First, the first paddle 34 and the second paddle 44 rotate with respect to the medium P2, which is mounted on or above the medium P1, to transport the medium P2 in direction +A. The first paddle 34 and the second paddle 44 transport the medium P2 until the medium P2 reaches the alignment section 52.

At this time, when a transporting force of the first paddle 34 or the second paddle 44 is large, the medium P2 is pressed against the alignment section 52 and bent. The medium P1 is also pressed against the alignment section 52 together with the medium P2 and bent.

The bending of the medium P2 and the medium P1 is eliminated when the first blade section 35 of the first paddle 34 and the second blade section 45 of the second paddle 44 separate from the medium. Elimination of the bending results in a force for moving in direction −A being applied to the medium P1 and the medium P2, and, upon receiving the force, the media P1 and P2 move in direction −A.

When the first paddle 34 and the second paddle 44 are rotated to realign the medium P1 and the medium P2 in the aforementioned state, misalignment may be caused. Specifically, the state is such that only the edge portion of the medium P2 on the direction +A side reaches the alignment section 52 and such that the edge portion of the medium P1 on the direction +A side does not reach the alignment section 52.

A reason for the misalignment is a difference in force between a direction −B component applied to the medium P2 and a direction −B component applied to the medium P1.

Figure 5:
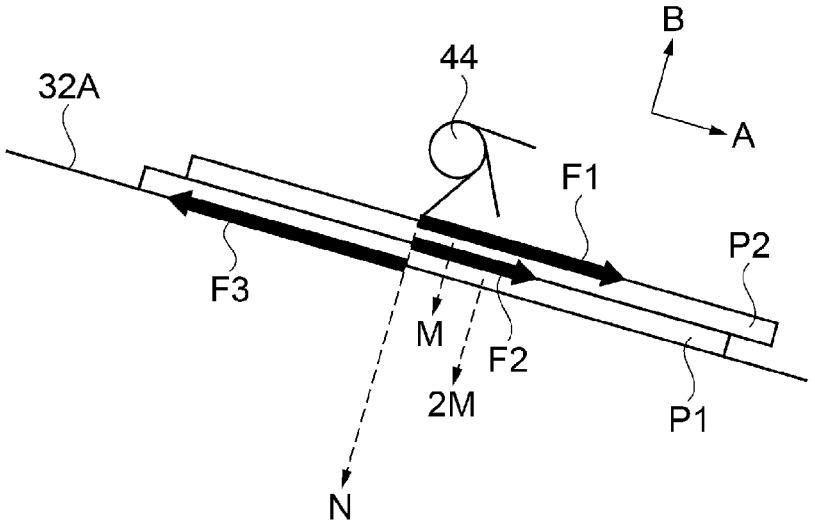
FIG. 5 illustrates a relationship between forces applied to a medium mounted on the processing tray according to the first embodiment.

The difference in force between the direction −B component applied to the medium P2 and the direction −B component applied to the medium P1 will be described with reference to FIG. 5. Here, the configuration is simplified, and description will be given on the assumption that only the second paddle 44 applies a force to each of the media P1 and P2.

It is assumed that the medium P2 is the second medium, that a direction −B component of gravity acting on the media P1 and P2 is M, and that a force of a direction −B component applied to the media P1 and P2 by the second paddle 44 is N.

Further, it is assumed that a coefficient of friction between the second paddle 44 and the medium P2 is μ1, that a coefficient of friction between the medium P1 and the medium P2 is μ2, and that a coefficient of friction between the medium P1 and the upper surface 32A is μ3. It is assumed here that μ1, μ2, and μ3 are each a coefficient of friction at a point at which the second paddle 44 applies a force to the media P1 and P2 or a point equivalent thereto.

When a force of a direction A component, which is applied to the medium P2 by the second paddle 44, is F1, a force of a direction A component, with which the medium P2 moves the medium P1, is F2, and a force of a direction A component, which is generated between the upper surface 32A and the medium P1, is F3, F1, F2, and F3 are expressed as follows.

$$F1=\mu 1N$$

$$F2=\mu 2(M+N)$$

$$F3=\mu 3(2M+N)$$

In the aforementioned expressions, force magnitude satisfies F3>F1>F2. The state is thus such that it is difficult for the medium P1 to move relative to movement of the medium P2.

Accordingly, when the second paddle 44 applies the transporting force to the medium P2 which has been moved in direction −A, the state may be such that only the edge portion of the medium P2 on the direction +A side reaches the alignment section 52 and such that the edge portion of the medium P1 on the direction +A side does not reach the alignment section 52. That is, misalignment between the medium P1 and the medium P2 may be caused.

The load member 90 is also effective for addressing such misalignment.

That is, the load member 90 hinders potential movement of the medium P1 in direction −A by coming into contact with the medium P1 and applying a load.

Accordingly, even when the medium P1 and the medium P2 are bent and elimination of the bending causes potential movement of the medium P1 in direction −A, the load member 90 hinders the movement.

This reduces possible movement of the medium P1 in direction −A during alignment of the medium P2, and, even after the medium P2 which has moved in direction −A is transported in direction +A, possible misalignment caused between the medium P2 and the medium P1 is able to be reduced.

Note that, although the load member 90 also applies a load when the first medium P1 mounted on the processing tray 32 is transported in direction +A, since the load member 90 protrudes toward the alignment section 52, it is possible to make the load applied when the medium P1 is transported in direction +A smaller than the load applied when the medium P1 is transported in direction −A.

It is thereby possible to reduce misalignment of the medium P1 while retaining accuracy in transporting the first medium P1.

Moreover, as post-processing, it is possible to punch the medium P by using a punch unit 83, which corresponds to a punching section. As illustrated in FIG. 1, the punch unit 83 is provided on the transport path K, performs punching processing for the medium P before the medium P is mounted on the processing tray 32, and forms a punched hole, which corresponds to a hole, in the medium P.

In the present embodiment, the load member 90 is provided at a position outside a movement locus of the punched hole formed in the medium P in a transporting process. In other words, the load member 90 is arranged at a position that does not overlap the punched hole.

It is therefore possible to reduce misalignment caused when the punched hole of the medium P and the load member 90 interfere with each other.

The movement locus of the punched hole includes, at least, a movement locus of the punched hole when the medium P subjected to punching processing is discharged onto the processing tray 32, a movement locus of the punched hole when the medium P subjected to punching processing is transported by the first paddle 34 and the second paddle 44, a movement locus of the punched hole when the medium P subjected to the punching processing is subjected to shift processing, and a movement locus of the punched hole when the medium P subjected to punching processing is discharged by the roller pair 47.

In the aforementioned embodiment, although the medium P2 is described as the second medium P mounted on the processing tray 32, the medium P2 is not limited to the second medium P, and the same is applicable to the third medium P and a medium P after the third medium P.

Second Embodiment

Next, a second embodiment will be described. In the following description, the same constituents as those of the first embodiment will be given the same reference numerals, and redundant description will be omitted.

The second embodiment differs from the first embodiment in that a load member is provided on the upper surface 32A of the processing tray 32.

It is assumed below that the first medium P mounted on the processing tray 32 is the medium P1 and that the medium P which is mounted on or above the medium P1 and is being transported by the first paddle 34 and the second paddle 44 in direction +A is the medium P2.

Figure 7:
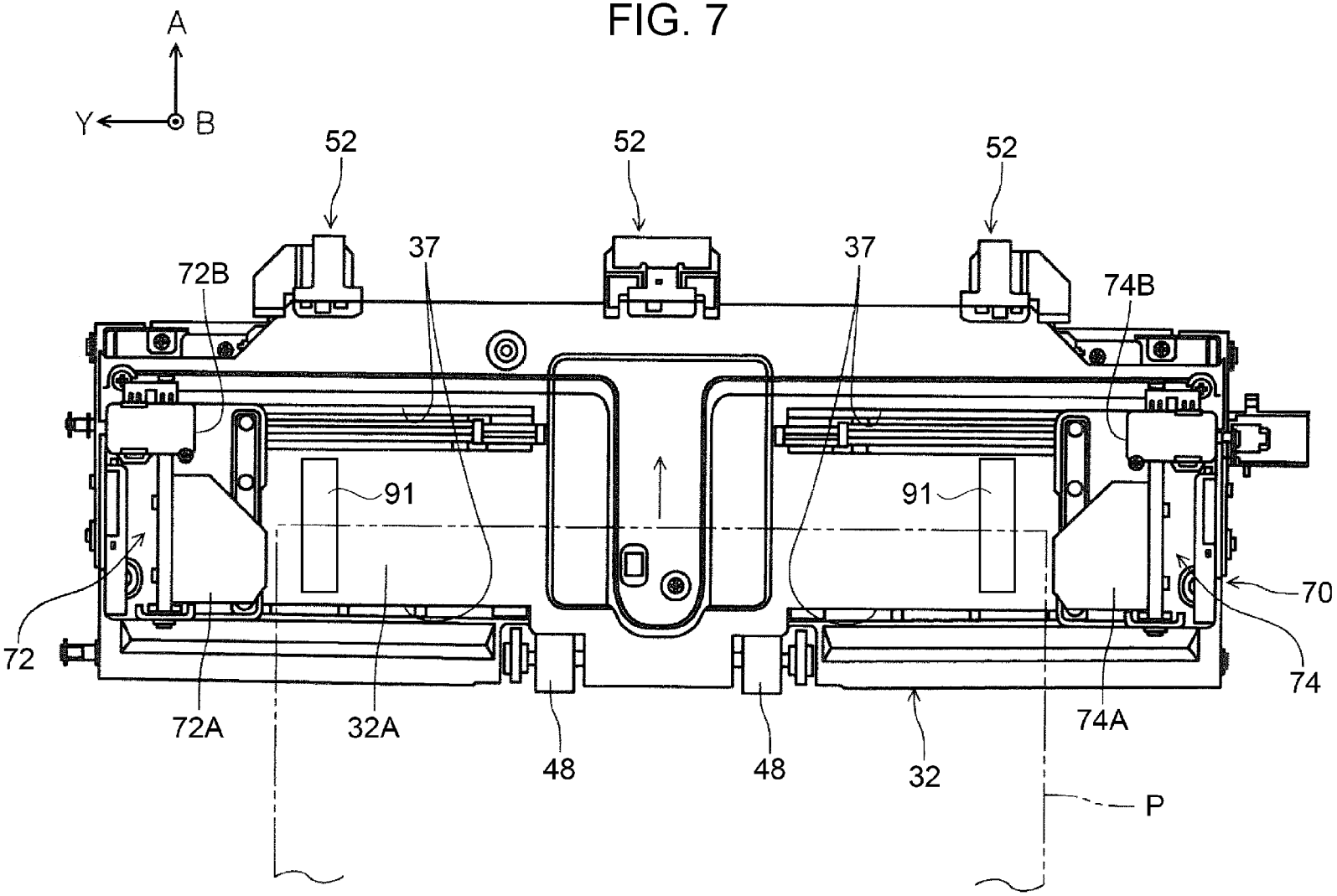
FIG. 7 is a plan view of a processing tray according to a second embodiment.

As illustrated in FIG. 7, a load member 91 of the second embodiment is formed of cork, whose surface frictional force is relatively great, and attached so as to extend along the upper surface 32A. When the medium P1 which is in contact with the load member 91 moves in direction −A, the load member 91 applies a load to the medium P1. The relatively great frictional force means a frictional force sufficient to enable the load member 91 to hinder the medium P1 from moving in direction −A. In this instance, the load member 91 is not limited to being formed of cork, and another material may be used as long as the material has a frictional force sufficient to hinder the medium P1 from moving in direction −A.

Accordingly, even when the medium P1 is pressed against the alignment section 52 and bent when the medium P1 is being aligned on the processing tray 32, since the load member 91 applies a load that hinders the medium P1 from moving in direction −A, it is possible to reduce misalignment.

Moreover, similarly to the first embodiment, it is also possible to reduce misalignment caused when the medium bundle Q is being formed.

Even when the medium P1 and the medium P2 are bent during alignment of the medium P2 and elimination of the bending causes potential movement of the medium P1 in direction −A, the load member 91 hinders the movement.

This reduces possible movement of the medium P1 in direction −A during alignment of the medium P2. Accordingly, even after the medium P2 which has moved in direction −A is transported in direction +A, possible misalignment caused between the medium P1 and the medium P2 is able to be reduced.

The load member 91 applies an equivalent load when the medium P1 is transported in direction +A and when the medium P1 is transported in direction −A.

Accordingly, the state is such that it is difficult for the medium P1 which is in contact with the load member 91 to move in direction +A.

In the present embodiment, an impulse applied to the medium P by the first paddle 34 and the second paddle 44 is able to be changed in accordance with a stacking state of the medium P on the processing tray 32. The stacking state here indicates whether or not the medium P has been already mounted on the processing tray 32. In other words, the stacking state indicates whether the medium P to be discharged to the processing tray 32 is, of media P forming the medium bundle Q, the first medium P1 or the medium P2 which is the second medium or a medium after the second medium.

The impulse applied to the medium P by the first paddle 34 and the second paddle 44 is obtained by multiplying a transporting force of a direction +A component of a transporting force applied to the medium P by the first paddle 34 and the second paddle 44 by a transporting time during which the medium P is transported.

Specifically, when a transporting force of a direction +A component applied to the medium P1 by the first paddle 34 and the second paddle 44 is Fd1 and when a transporting time is t1, an impulse X1 applied to the medium P1 by the first paddle 34 and the second paddle 44 is expressed by Fd1×t1.

Moreover, when a transporting force of a direction +A component applied to the medium P2 by the first paddle 34 and the second paddle 44 is Fd2 and when a transporting time is t2, an impulse X2 applied to the medium P2 by the first paddle 34 and the second paddle 44 is expressed by Fd2×t2.

The second control section 23 performs control such that the impulse X1 applied when the medium P1 is transported toward the alignment section 52 is greater than the impulse X2 applied when the medium P2 is transported toward the alignment section 52.

It is thereby possible to reliably transport the medium P1 to the alignment section 52 even in the configuration in which the load member 91 is provided on the processing tray 32.

Accordingly, possible misalignment caused between the medium P1 and the medium P2 is able to be reduced.

To make values of the impulse X1 and the impulse X2 different from each other, only values of the transporting times t1 and t2 may be changed while the same value is set to the transporting forces Fd1 and Fd2. On the other hand, only the values of the transporting forces Fd1 and Fd2 may be changed while the same value is set to the transporting times t1 and t2. Needless to say, both values of the transporting forces Fd1 and Fd2 and values of the transporting times t1 and t2 may be changed.

Moreover, the second control section 23 does not necessarily adjust the impulse applied to the medium P by the first paddle 34 and the second paddle 44 and may control a transporting amount by which the medium P is transported to the alignment section 52.

Specifically, the second control section 23 makes a transporting amount by which the medium P1 is transported toward the alignment section 52 larger than a transporting amount by which the medium P2 is transported toward the alignment section 52. The transporting amount here means a moving amount by which the first paddle 34 and the second paddle 44 move the medium P1 toward the alignment section 52.

Accordingly, it is possible to reliably transport the medium P1 to the alignment section 52 even in the configuration in which the load member 91 is provided on the processing tray 32, thus making it possible to reduce possible misalignment caused between the medium P1 and the medium P2.

In the aforementioned embodiment, although the medium P2 is described as the second medium P mounted on the processing tray 32, the same is applicable to the third medium P and a medium P after the third medium P.

Third Embodiment

Next, a third embodiment will be described. In the following description, the same constituents as those of the first embodiment and the second embodiment will be given the same reference numerals, and redundant description will be omitted.

The third embodiment differs from the first embodiment and the second embodiment in that an applied state of a load to be applied to the medium P is switchable.

It is assumed below that the first medium P mounted on the processing tray 32 is the medium P1 and that the medium P which is mounted on or above the medium P1 and is being transported by the first paddle 34 and the second paddle 44 in direction +A is the medium P2.

Figure 8:
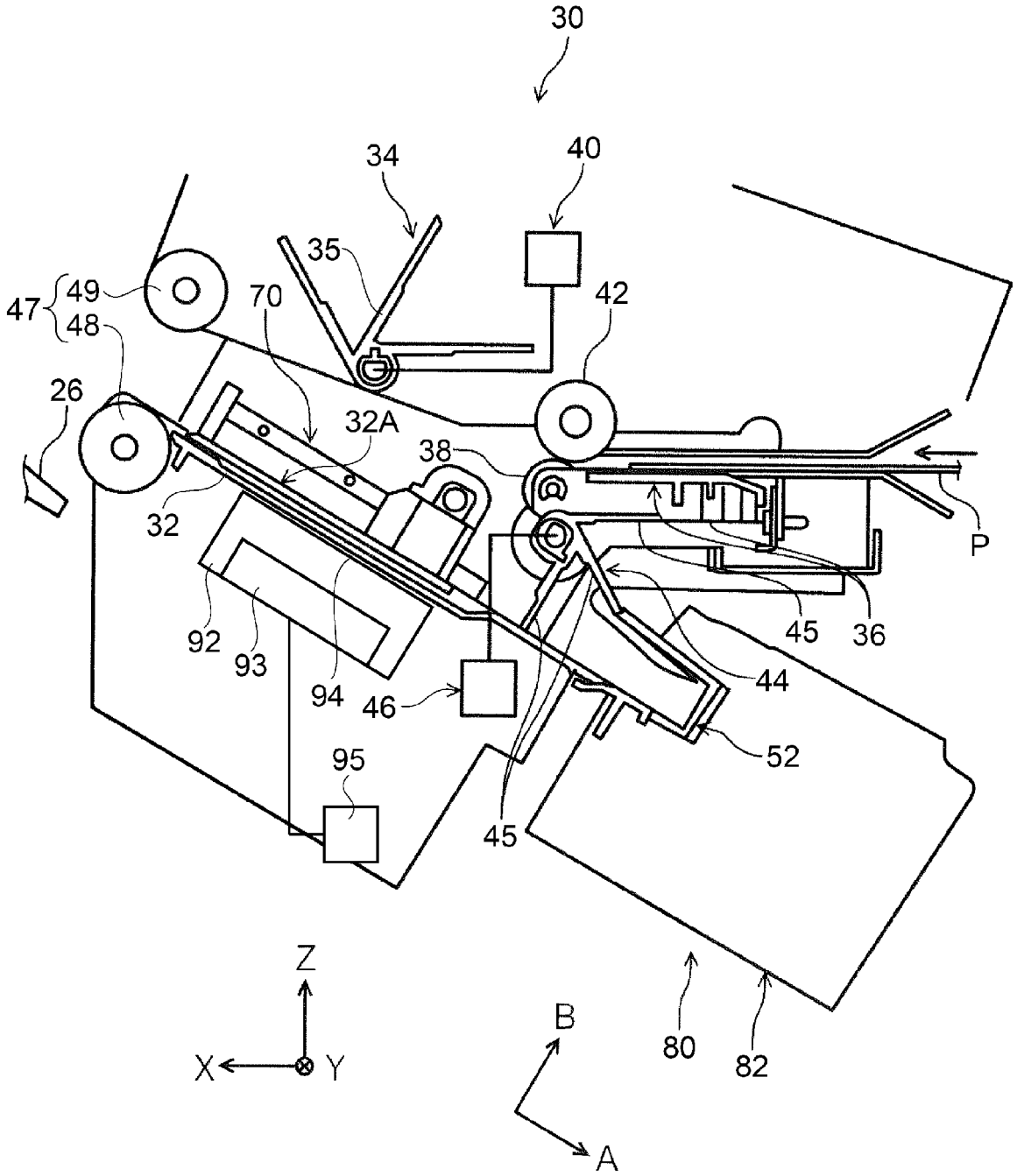
FIG. 8 is a sectional view of a processing tray according to a third embodiment.

As illustrated in FIG. 8, in the present embodiment, a sucking section 92 is used as the load applying section.

The sucking section 92 includes a sucker 93 and a sucking port 94 which are arranged below the processing tray 32 as illustrated in FIG. 8. The sucker 93 is driven by a third drive section 95. The third drive section 95 includes a motor and a gear, which are not illustrated. Drive of the motor is controlled by the second control section 23.

A hole section (not illustrated) is provided in the processing tray 32 at a position corresponding to the sucking port 94.

The sucker 93 performs operation of sucking air from the sucking port 94 and thereby generates adhering power with respect to the medium P1 mounted on the processing tray 32. The second control section 23 controls ON/OFF of the sucker 93.

A suction pump or a suction fan is able to be used as the sucker 93.

More specifically, the sucking section 92 illustrated in FIG. 8 is sucked by the sucker 93 and has a pressure in its interior space made negative. The sucking section 92 is provided with the sucking port 94 in an upper portion facing the processing tray 32, and adhering power acts, as a load, on the medium P1 passing above the sucking section 92. That is, the second control section 23 is able to switch, by controlling the sucking operation performed by the sucker 93, an applied state of a load to be applied to the medium P1.

The adhering power is generated by the sucking section 92 desirably at a timing at which the medium P1 reaches the alignment section 52. That is, the sucking section 92 performs no sucking operation when the medium P1 moves in direction +A toward the alignment section 52 and performs the sucking operation at the timing at which the medium P1 reaches the alignment section 52.

By generating the adhering power at the aforementioned timing, it is possible to reduce bending of the medium P1 when the medium P1 is pressed against the alignment section 52 by the first paddle 34 and the second paddle 44.

Even when the medium P1 is bent, since the adhering power is generated with respect to the medium P1, possible movement of the medium P1 in direction −A is able to be reduced.

Accordingly, even when the medium P1 is pressed against the alignment section 52 and bent while aligned on the processing tray 32, since the sucking section 92 applies the load to hinder the medium P1 from moving in direction −A, misalignment is able to be reduced.

In this manner, the configuration in which the applied state of a load to be applied by the load applying section is switchable and in which, at least when the medium P1 moves in direction −A, a load is applied in a direction in which the movement is hindered enables misalignment to be reduced.

Moreover, according to the above-described configuration, the load applied to the medium when the medium P1 moves in direction +A is able to be made smaller than the load applied when the medium P1 moves in direction −A, thus making it possible to reliably transport the medium P1 to the alignment section 52.

Further, misalignment caused when the medium bundle Q is being formed is also able to be reduced.

As described above, the sucking section 92 generates adhering power at the timing at which the medium P1 reaches the alignment section 52. Accordingly, even when the medium P1 and the medium P2 are bent during alignment of the medium P2 and elimination of the bending causes potential movement of the medium P1 in direction −A, the sucking section 92 hinders the movement.

This reduces possible movement of the medium P1 in direction −A during alignment of the medium P2. Accordingly, even after the medium P2 which has moved in direction −A is transported in direction +A, possible misalignment caused between the medium P2 and the medium P1 is able to be reduced.

Note that, after starting sucking, the sucking section 92 may continue sucking until forming the medium bundle Q is finished or may stop sucking at a predetermined timing. In addition, misalignment of the medium P may be reduced by repeating stopping and sucking.

The second control section 23 may adjust the adhering power not only by controlling ON/OFF of the sucker 93 but also by adjusting a suction amount. In this instance, the configuration may be such that misalignment is reduced by changing the adhering power.

In the aforementioned embodiment, although the adhering power is generated by the sucking section 92 desirably at the timing at which the medium P1 reaches the alignment section 52, there is no limitation thereto. For example, the adhering power may be generated before the medium P1 reaches the alignment section 52 such that possible bending of the medium P1, which is caused when the medium P1 comes into contact with the alignment section 52, is reduced. Moreover, the configuration may be such that the adhering power generated after the medium P1 has reached the alignment section 52 prevents misalignment while the trailing end of the medium P1 is reliably aligned.

In the aforementioned embodiment, although the medium P2 is described as the second medium P mounted on the processing tray 32, the same is applicable to the third medium P and a medium P after the third medium P.

Fourth Embodiment

Next, a fourth embodiment will be described. In the following description, the same constituents as those of the first to the third embodiments will be given the same reference numerals, and redundant description will be omitted.

The fourth embodiment is the same as the third embodiment in that an applied state of a load to be applied to the medium P is switchable and differs from the third embodiment in the configuration of the load applying section.

It is assumed below that the first medium P mounted on the processing tray 32 is the medium P1 and that the medium P which is mounted on or above the medium P1 and is being transported by the first paddle 34 and the second paddle 44 in direction +A is the medium P2.

In the fourth embodiment, a third paddle 96 is used as the load applying section.

Figure 9:
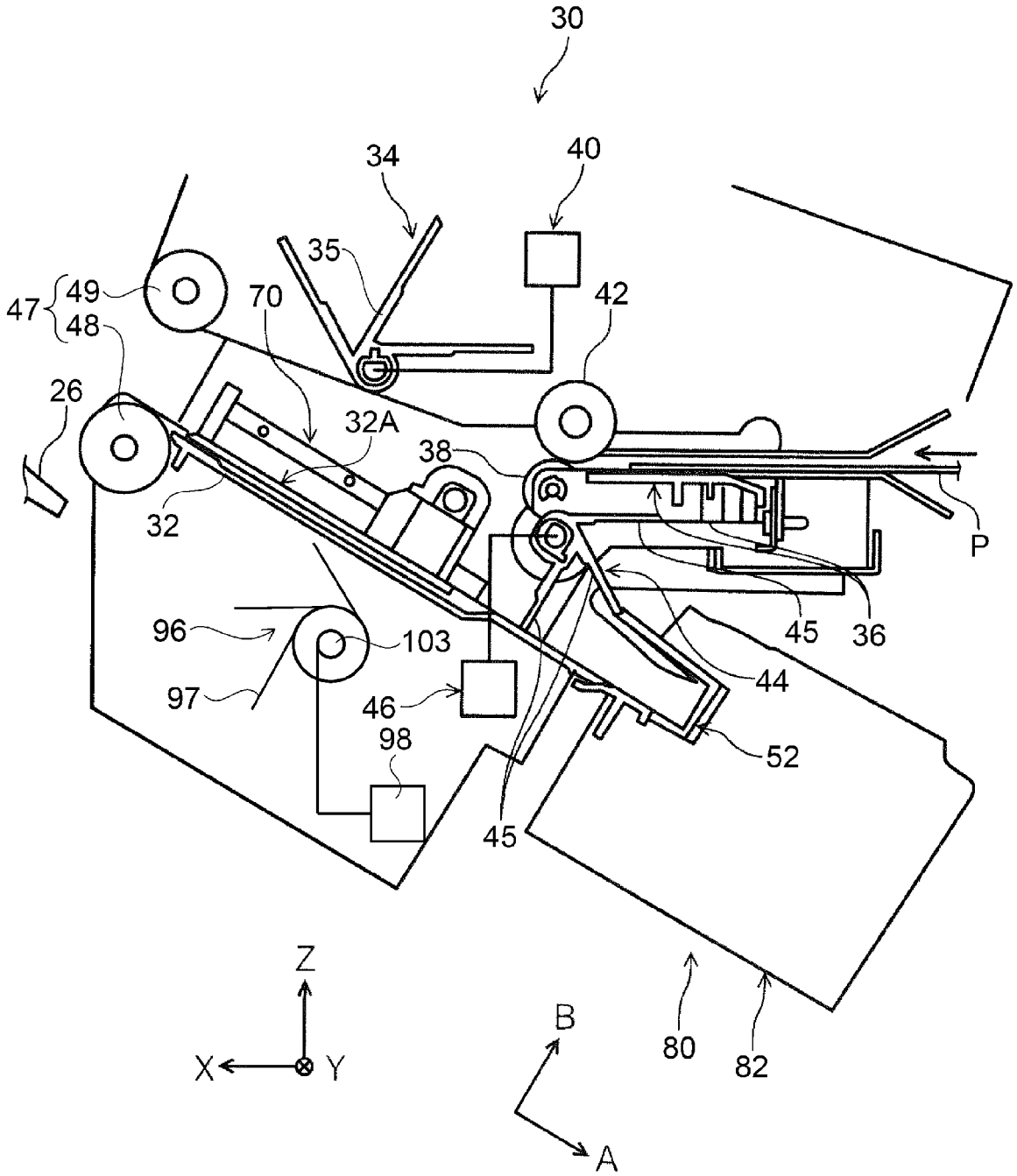
FIG. 9 is a sectional view of a processing tray according to a fourth embodiment.

As illustrated in FIG. 9, the third paddle 96 is provided in the −Z direction with respect to the processing tray 32 so as to be rotatable with the Y direction as an axial direction. The third paddle 96 includes, for example, three third blade sections 97 and a rotational shaft 103.

The third paddle 96 is driven by a fourth drive section 98. The fourth drive section 98 includes a motor and a gear, which are not illustrated. Drive of the motor is controlled by the second control section 23.

Each of the third blade sections 97 of the third paddle 96 is configured to be switchable between an advancing state in which the third blade section 97 protrudes from the upper surface 32A of the processing tray 32 and a retreat state in which the third blade section 97 retreats lower than the upper surface 32A of the processing tray 32.

More specifically, the rotational shaft 103 of the third paddle 96 is arranged under the processing tray 32, and the third paddle 96 is configured to be switchable, by rotating, between the advancing state in which a portion of the third blade sections 97 protrudes from the upper surface 32A of the processing tray 32 and the retreat state in which the whole of the third blade sections 97 retreats lower than the upper surface 32A of the processing tray 32.

In this manner, in the advancing state, at least a portion of the three third blade sections 97 of the third paddle 96 advances above the processing tray 32.

Moreover, in the retreat state, the whole of the three third blade sections 97 of the third paddle 96 retreats under the processing tray 32.

The third blade sections 97 are configured to rotate clockwise in FIG. 9. In other words, the third blade sections 97 in the advancing state rotate such that a portion protruding from the upper surface 32A of the processing tray 32 moves in direction +A.

Accordingly, the configuration is such that, in a step in which the medium P1 is aligned, the third paddle 96 is able to apply a load to the medium P1 so as to hinder the medium P1 from moving in direction −A.

The third paddle 96 starts rotating desirably at a timing at which the medium P1 reaches the alignment section 52. That is, the third paddle 96 does not rotate when the medium P1 moves in direction +A toward the alignment section 52 and starts rotating at the timing at which the medium P1 reaches the alignment section 52.

Even when the medium P1 is pressed against the alignment section 52 and bent, the third paddle 96 starts rotating at the above-described timing and applies a load to the medium P1 so as to hinder the movement in direction −A, thus making it possible to reduce misalignment.

In this manner, the configuration in which the applied state of a load to be applied by the load applying section is switchable and in which, at least when the medium P1 moves in direction −A, a load is applied in a direction in which the movement is hindered enables misalignment to be reduced.

Moreover, according to the above-described configuration, the load applied to the medium when the medium P1 moves in direction +A is able to be made smaller than the load applied when the medium P1 moves in direction −A, thus making it possible to reliably transport the medium P1 to the alignment section 52.

Further, misalignment caused when the medium bundle Q is being formed is also able to be reduced.

Even when the medium P1 and the medium P2 are bent during alignment of the medium P2 and elimination of the bending causes potential movement of the medium P1 in direction −A, the third paddle 96 hinders the movement.

This reduces possible movement of the medium P1 in direction −A during alignment of the medium P2. Accordingly, even after the medium P2 which has moved in direction −A is transported in direction +A, possible misalignment caused between the medium P2 and the medium P1 is able to be reduced.

Note that, after starting rotating, the third paddle 96 may continue rotating until forming the medium bundle Q is finished or may stop rotating at a predetermined timing. In addition, misalignment of the medium P may be reduced by repeating stopping and rotating.

Moreover, the third paddle 96 may be configured to start rotating at the timing at which the medium P1 reaches the alignment section 52 and stop rotating when the third blade section 97 is in the advancing state in which the third blade section 97 protrudes from the upper surface 32A.

According to the above-described configuration, since the third blade section 97 comes into contact with the medium P1 which has reached the alignment section 52, it is possible to apply a load in a direction in which potential movement of the medium P1 in direction −A is hindered.

In the aforementioned embodiment, although the third paddle 96 starts rotating desirably at the timing at which the medium P1 reaches the alignment section 52, there is no limitation thereto. For example, the third paddle 96 may rotate before the medium P1 reaches the alignment section 52 so as to assist operation of transporting the medium P1 to the alignment section. Moreover, the configuration may be such that the third paddle 96 rotating after the medium P1 has reached the alignment section 52 prevents misalignment while the trailing end of the medium P1 is reliably aligned.

In the aforementioned embodiment, although the medium P2 is described as the second medium P mounted on the processing tray 32, the same is applicable to the third medium P and a medium P after the third medium P.

Fifth Embodiment

Next, a fifth embodiment will be described. In the following description, the same constituents as those of the first to the fourth embodiments will be given the same reference numerals, and redundant description will be omitted.

The fifth embodiment is the same as the third embodiment and the fourth embodiment in that an applied state of a load to be applied to the medium P is switchable and differs from the third embodiment and the fourth embodiment in the configuration of the load applying section.

It is assumed below that the first medium P mounted on the processing tray 32 is the medium P1 and that the medium P which is mounted on or above the medium P1 and is being transported by the first paddle 34 and the second paddle 44 in direction +A is the medium P2.

Although, as described above, the roller pair 47 including the first discharging roller 48 and the second discharging roller 49 is driven when the medium bundle Q subjected to post-processing by the post-processing section 80 is discharged, the first discharging roller 48 functions as the load applying section when the medium P is aligned on the processing tray 32, in the present embodiment.

The first discharging roller 48 is provided so as to be able to come into contact with the lowest medium P1 of the media P mounted on the processing tray 32. The first discharging roller 48 is configured to be able to be driven by a drive source (not illustrated).

Although details will be described later, it is possible to prevent misalignment of the medium P1 by using, as a load, friction generated when the medium P1 comes into contact with the first discharging roller 48.

Figure 10:
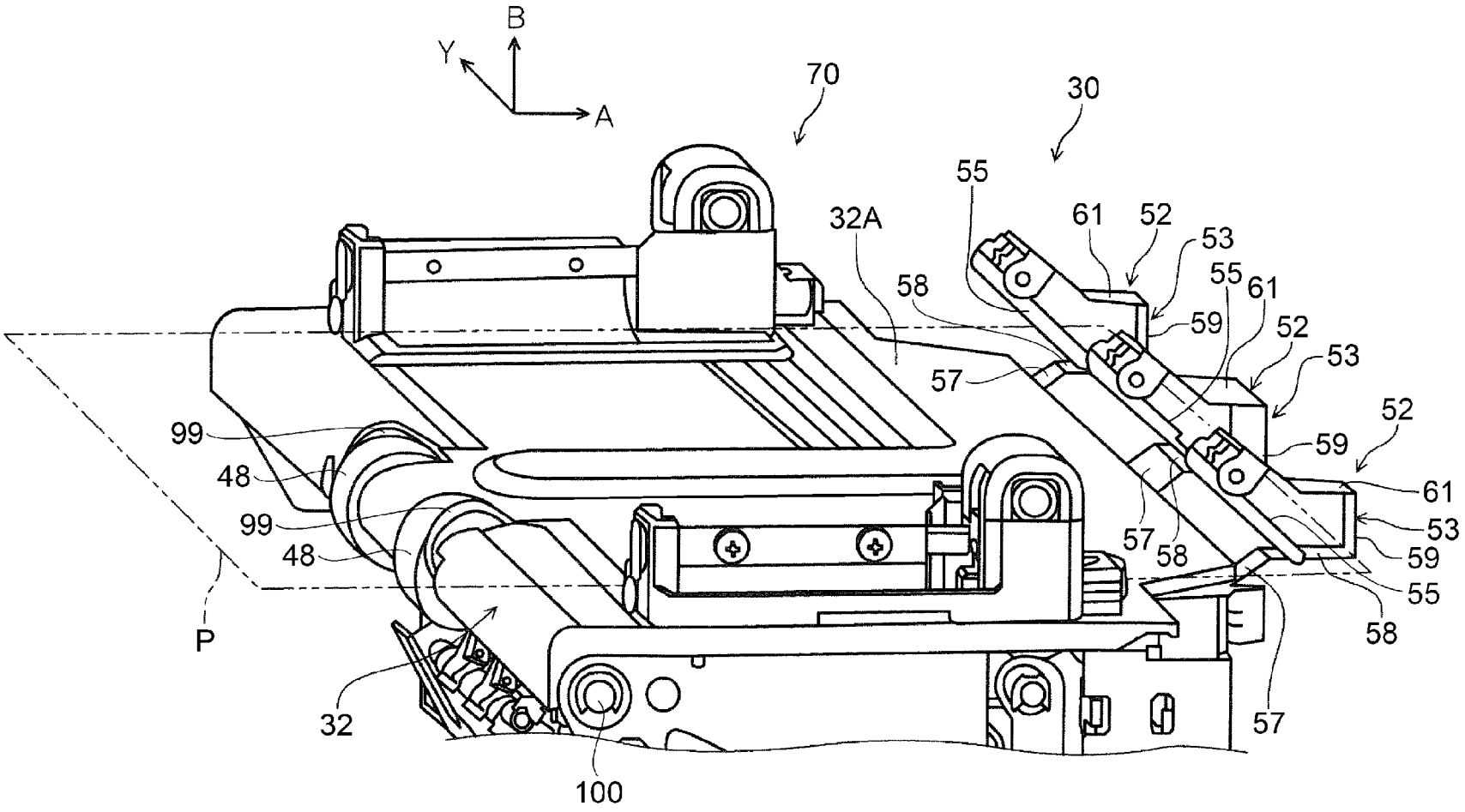
FIG. 10 is a perspective view of a processing tray according to a fifth embodiment.
Figure 11:
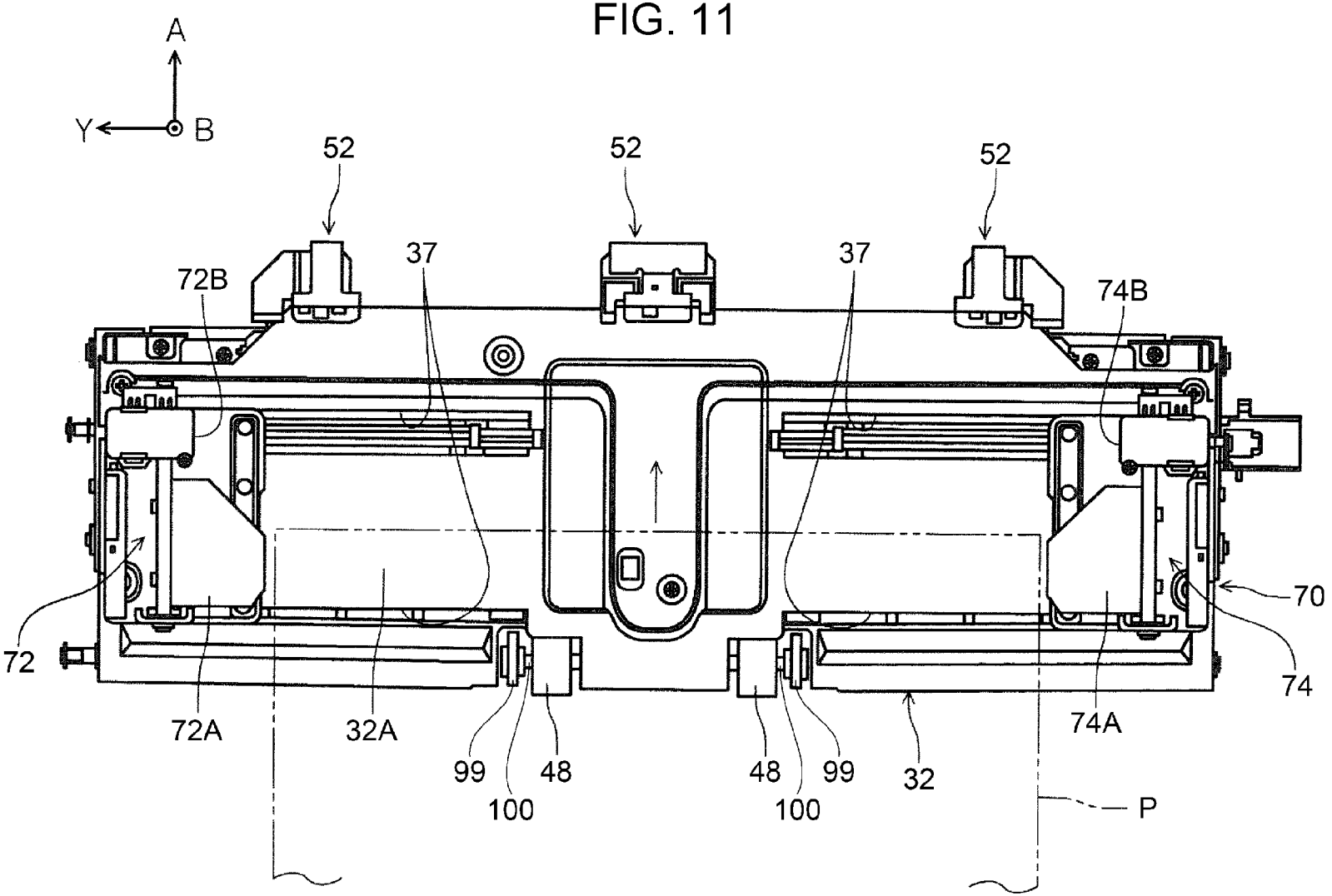
FIG. 11 is a plan view of the processing tray according to the fifth embodiment.

As illustrated in FIGS. 10 and 11, an avoidance cam 99, which corresponds to a switching member for switching the first discharging roller 48 and the medium P1 between a contact state and a separation state, is provided next to the first discharging roller 48. The avoidance cam 99 is attached to a roller shaft 100, which corresponds to a rotational shaft of the first discharging roller 48, and provided so as to rotate integrally with the roller shaft 100. The avoidance cam 99 is an eccentric cam.

Figure 12A:
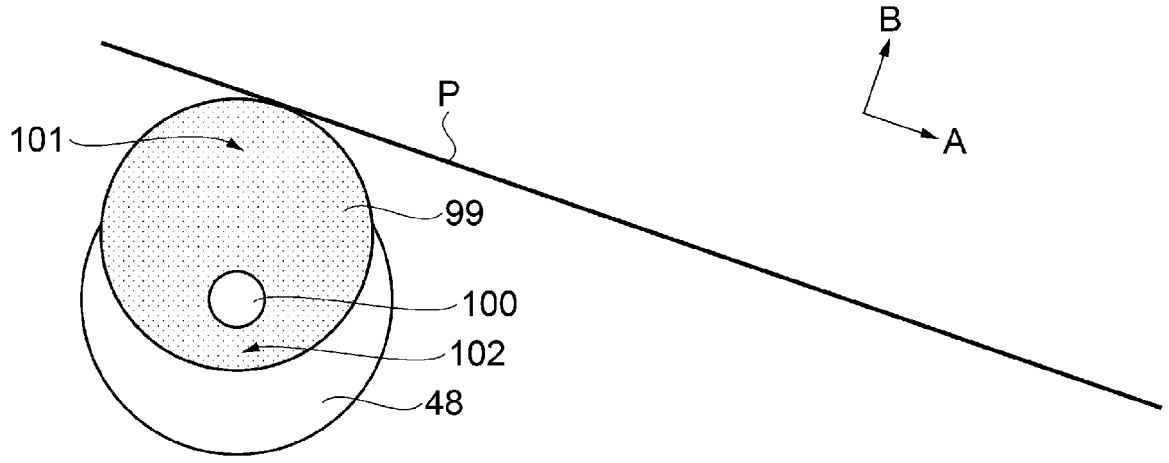
FIG. 12A is a side view illustrating an avoidance cam according to the fifth embodiment.
Figure 12B:
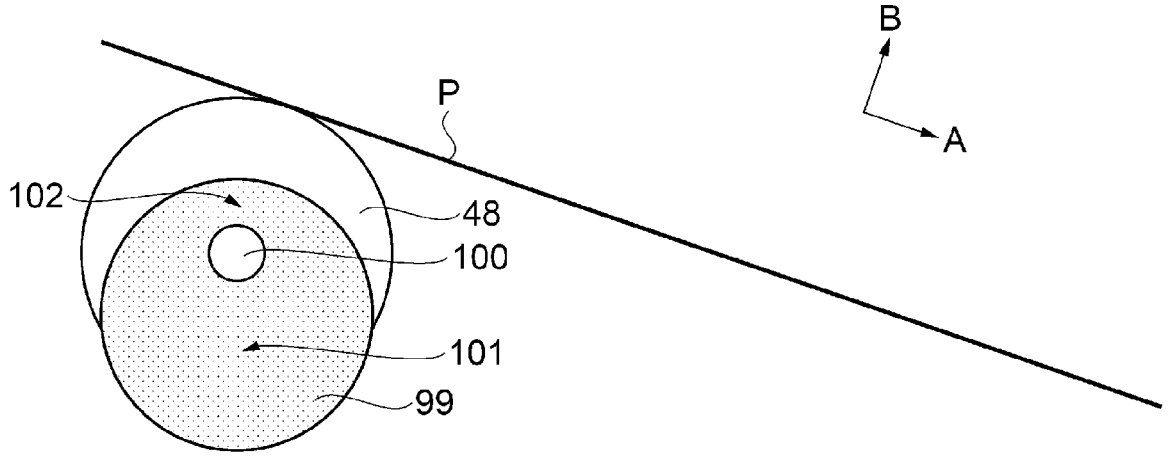
FIG. 12B is a side view illustrating the avoidance cam according to the fifth embodiment.

As illustrated in FIGS. 12A and 12B, the avoidance cam 99 includes a large-diameter section 101 configured such that a diameter of a portion of the cam surface is larger than the diameter of the first discharging roller 48 and a small-diameter section 102 configured such that a diameter of a portion of the cam surface is smaller than the diameter of the first discharging roller 48.

Accordingly, when the roller shaft 100 is rotated to thereby rotate the avoidance cam 99, positions of the large-diameter section 101 and the small-diameter section 102 on the processing tray 32 are switched, and a contact state in which the medium P1 is in contact with the avoidance cam 99 as illustrated in FIG. 12A and a retreat state in which the medium P1 is not in contact with the avoidance cam 99 as illustrated in FIG. 12B are thus switchable. The medium P1 and the first discharging roller 48 are not in contact with each other in the contact state, and the medium P1 and the first discharging roller 48 are in contact with each other in the retreat state.

That is, by rotating the roller shaft 100 to thereby rotate the avoidance cam 99, it is possible to switch between the state in which the medium P1 is separated from the first discharging roller 48 as illustrated in FIG. 12A and the state in which the medium P1 is in contact with the first discharging roller 48 as illustrated in FIG. 12B.

In the fifth embodiment, by controlling the position of the avoidance cam 99, it is possible to switch between a state in which the medium P is in contact with the first discharging roller 48, that is, a state in which a load is applied to the medium P by the first discharging roller 48, and a state in which the medium P is separated from the first discharging roller 48, that is, a state in which no load is applied to the medium P.

The first discharging roller 48 is formed of rubber whose surface frictional force is relatively great. The relatively great frictional force means a frictional force sufficient to hinder the medium P1 from moving in direction −A. The material of the first discharging roller 48 is not limited to rubber and may be another material as long as the material has the frictional force sufficient to hinder the medium P1 from moving in direction −A.

On the other hand, the avoidance cam 99 is formed of a resin and configured such that friction generated against the medium P1 is smaller than friction generated between the medium P1 and the first discharging roller 48. The material of the avoidance cam 99 is not limited to a resin and may be another material.

The medium P1 and the first discharging roller 48 are brought into contact with each other desirably at a timing at which the medium P1 reaches the alignment section 52. That is, the avoidance cam 99 is configured to cause the medium P1 and the first discharging roller 48 to separate from each other when the medium P1 moves in direction +A toward the alignment section 52 and causes the medium P1 and the first discharging roller 48 to come into contact with each other at the timing at which the medium P1 reaches the alignment section 52.

By causing the medium P1 and the first discharging roller 48 to come into contact with each other at the above-described timing, it is possible to reduce bending of the medium P1 when the medium P1 is pressed against the alignment section 52 by the first paddle 34 and the second paddle 44.

Even when the medium P1 is bent, since a load is applied to the medium P1 by the first discharging roller 48, possible movement of the medium P1 in direction −A is able to be reduced.

Accordingly, even in an instance in which the medium P1 is pressed against the alignment section 52 and bent when the medium P1 is being aligned on the processing tray 32, since the first discharging roller 48 applies a load that hinders the medium P1 from moving in direction −A, misalignment is able to be reduced.

In this manner, the configuration in which the applied state of a load to be applied by the load applying section is switchable and in which, at least when the medium P1 moves in direction −A, a load is applied in a direction in which the movement is hindered enables misalignment to be reduced.

Moreover, according to the above-described configuration, the load applied to the medium when the medium P1 moves in direction +A is able to be made smaller than the load applied when the medium P1 moves in direction −A, thus making it possible to reliably transport the medium P1 to the alignment section 52.

In addition, when the roller shaft 100 rotates, the avoidance cam 99 is switchable between the state in which the medium P is in contact with the first discharging roller 48 and the state in which the medium P is separated from the first discharging roller 48, and it is therefore possible to switch application of the load without newly using a drive source.

Further, misalignment caused when the medium bundle Q is being formed is also able to be reduced similarly to the first embodiment and the second embodiment.

Even when the medium P1 and the medium P2 are bent during alignment of the medium P2 and elimination of the bending causes potential movement of the medium P1 in direction −A, the first discharging roller 48 hinders the movement.

This reduces possible movement of the medium P1 in direction −A during alignment of the medium P2. Accordingly, even after the medium P2 which has moved in direction −A is transported in direction +A, possible misalignment caused between the medium P2 and the medium P1 is able to be reduced.

Note that, the avoidance cam 99 that has been brought into the retreat state may remain in the retreat state until forming the medium bundle Q is finished or may shift to the contact state at a predetermined timing. In addition, misalignment of the medium P may be reduced by repeating the contact state and the retreat state.

In the aforementioned embodiment, although the medium P1 and the first discharging roller 48 are brought into contact with each other desirably at the timing at which the medium P1 reaches the alignment section 52, there is no limitation thereto. For example, the medium P1 and the first discharging roller 48 may be brought into contact with each other before the medium P1 reaches the alignment section 52 such that possible bending of the medium P1, which is caused when the medium P1 comes into contact with the alignment section 52, is reduced. Moreover, the configuration may be such that the first discharging roller 48 being brought into contact with the medium P1 after the medium P1 has reached the alignment section 52 prevents misalignment while the trailing end of the medium P1 is reliably aligned.

Note that, when the medium bundle Q subjected to post-processing by the post-processing section 80 is discharged, the medium bundle Q on the processing tray 32 is pressed by the second discharging roller 49. Accordingly, even when, during a process in which the roller shaft 100 is rotated, the avoidance cam 99 shifts to the contact state of being in contact with the medium P1, since the medium bundle Q is pressed and bent, the first discharging roller 48 and the second discharging roller 49 are able to hold the medium bundle Q therebetween and discharge the medium bundle Q.

In the aforementioned embodiment, although the medium P2 is described as the second medium P mounted on the processing tray 32, the same is applicable to the third medium P and a medium P after the third medium P.

Moreover, in the first embodiment to the fifth embodiment, control performed by the second control section 23 may be performed by the first control section 22 instead.

What is claimed is:

1. A post-processing device comprising:

a processing tray including a mounting surface on which a medium subjected to recording by a liquid ejecting apparatus is mounted;

a transporting member that transports, in a first direction, the medium mounted on the mounting surface;

an edge alignment section that aligns an edge portion of the medium, which was transported in the first direction by the transporting member, in the first direction;

a post-processing section that performs post-processing for the medium aligned by the edge alignment section; and a load applying section that applies a load when the medium on the processing tray moves in a second direction opposite to the first direction, wherein the load applying section is a plate member having a first end that extends from a fixation member that extends beneath the processing tray and a second end that protrudes from the mounting surface and is inclined in the first direction.

2. The post-processing device according to claim 1, wherein the load applying section also applies a load when the medium moves in the first direction, and the load applied by the load applying section when the medium moves in the first direction is smaller than the load applied by the load applying section when the medium moves in the second direction.

3. The post-processing device according to claim 1, further comprising:

a punching section that punches the medium before the medium is mounted on the mounting surface, wherein the load applying section is arranged at a position which does not overlap a punched hole when the medium is transported.

4. A post-processing device comprising:

a processing tray including a mounting surface on which a medium subjected to recording by a liquid ejecting apparatus is mounted;

a transporting member that transports, in a first direction, the medium mounted on the mounting surface;

an edge alignment section that aligns an edge portion of the medium, which was transported in the first direction by the transporting member, in the first direction;

a post-processing section that performs post-processing for the medium aligned by the edge alignment section; and a load applying section that applies a load when the medium on the processing tray moves in a second direction opposite to the first direction, wherein the load applying section also applies a load when the medium moves in the first direction, and an impulse applied to a first medium by the transporting member when the first medium is transported in the first direction is greater than an impulse applied to a second medium or a medium after the second medium by the transporting member when the second medium or the medium after the second medium is transported in the first direction.

5. A post-processing device comprising:

a processing tray including a mounting surface on which a medium subjected to recording by a liquid ejecting apparatus is mounted;

a transporting member that transports, in a first direction, the medium mounted on the mounting surface;

an edge alignment section that aligns an edge portion of the medium, which was transported in the first direction by the transporting member, in the first direction;

a post-processing section that performs post-processing for the medium aligned by the edge alignment section; and a load applying section that applies a load when the medium on the processing tray moves in a second direction opposite to the first direction, wherein the load applying section is configured to apply a load when the medium moves in the first direction and switch an applied state of the load to be applied to the medium, and the load applied by the load applying section when the medium moves in the first direction is smaller than the load applied by the load applying section when the medium moves in the second direction.

6. The post-processing device according to claim 5, wherein the load applying section is arranged under the mounting surface such that a portion of the load applying section protrudes from the mounting surface, and the load applying section applies a load to a first medium by moving the portion in the first direction at a timing at which the first medium reaches the edge alignment section.

7. The post-processing device according to claim 5, wherein the load applying section is a sucking section configured to suck the medium mounted on the mounting surface by performing a sucking operation of sucking air from the mounting surface, does not perform the sucking operation when a first medium moves in the first direction, and performs the sucking operation at a timing at which the first medium reaches the edge alignment section.

8. The post-processing device according to claim 5, further comprising a discharging section that discharges the medium subjected to post-processing by the post-processing section, wherein the discharging section is constituted by a roller pair, the roller pair includes a first roller configured to be in contact with a lowest medium of media mounted on the processing tray and a second roller provided so as to face the first roller, and the load applying section applies a load to the medium by using the first roller.

9. The post-processing device according to claim 8, further comprising a switching member that switches the first roller and the medium between a contact state and a separation state, wherein the switching member causes the first roller and a first medium to separate from each other when the first medium moves in the first direction and causes the first roller and the first medium to come into contact with each other at a timing at which the first medium reaches the edge alignment section.

10. The post-processing device according to claim 9, wherein the switching member is provided around a rotational shaft of the first roller and constituted by an eccentric cam having a diameter larger than an outer periphery of the first roller and a diameter smaller than the outer periphery of the first roller, and the first roller and the medium are switched between the contact state and the separation state when the rotational shaft is rotated.

* * * * *